United States Patent [19]

McSwiney et al.

[11] 4,270,443

[45] Jun. 2, 1981

[54] CONVOLUTE PAPER TUBE FORMING APPARATUS AND METHOD

[75] Inventors: Thomas L. McSwiney, Rock Hill, S.C.; George S. Bomar, La Fayette; Oran W. Johnson, Calhoun, both of Ga.

[73] Assignee: Star Paper Tube, Inc., Rock Hill, S.C.

[21] Appl. No.: 923,673

[22] Filed: Jul. 11, 1978

[51] Int. Cl.[3] ..... B31C 3/00

[52] U.S. Cl. ..... 493/287; 271/202; 271/251; 271/69; 493/304

[58] Field of Search ..... 93/81 R; 271/202, 203, 271/251, 69

[56] References Cited

U.S. PATENT DOCUMENTS

| | | | |
|---|---|---|---|
| 883,949 | 4/1908 | Gohy | 93/82 |
| 914,384 | 3/1909 | Chesney | 93/81 R |
| 1,586,593 | 6/1926 | Wyman | 93/81 R |
| 2,130,727 | 9/1938 | Aument | 156/184 |
| 2,184,905 | 12/1939 | Brintnali | 271/202 X |
| 2,300,625 | 11/1942 | Martin | 271/251 |
| 3,073,218 | 1/1963 | Roediger et al. | 93/81 R |
| 3,134,310 | 5/1964 | Petee | 93/81 |
| 3,190,195 | 6/1965 | Snyderman et al. | 93/81 |
| 3,869,325 | 3/1975 | Witzig | 93/94 R |
| 4,040,618 | 8/1977 | Vermes et al. | 271/202 X |

*Primary Examiner*—Robert D. Baldwin

*Attorney, Agent, or Firm*—Richards, Shefte & Pinckney

[57] ABSTRACT

Apparatus for forming a convolute paper tube on a winding mandrel, including means for conveying a sheet of paper from a gluing and cutting apparatus longitudinally of the winding mandrel, with an edge of the paper sheet engaged in a longitudinal slot in the mandrel, to a position where the sheet edge is fully engaged with the mandrel suitably for winding. The conveying means includes a belt conveyor for slidable frictional engagement of the paper sheet to convey the paper sheet into winding position while being slidable with respect thereto so that the paper can remain in proper winding position while in continuing contact with the moving conveyor belt. Support wires, guides, trim rolls, and a stop are also provided in the apparatus for controlling the pick up, transport, alignment, and terminal position of the sheet. A method is provided for feeding paper sheets to a convolute paper tube winding mandrel including the steps of feeding the end of a web of paper into slidable frictional engagement with a conveyor belt, cutting the web at a predetermined length from the end to form a sheet of paper and release the sheet for transport by the conveyor, transporting the sheet by slidable frictional engagement with the conveyor longitudinally of the elongated winding means while in side-edgewise engagement with a longitudinal slot therein, and halting the sheet while in full length edgewise engagement with the elongated winding means.

29 Claims, 3 Drawing Figures

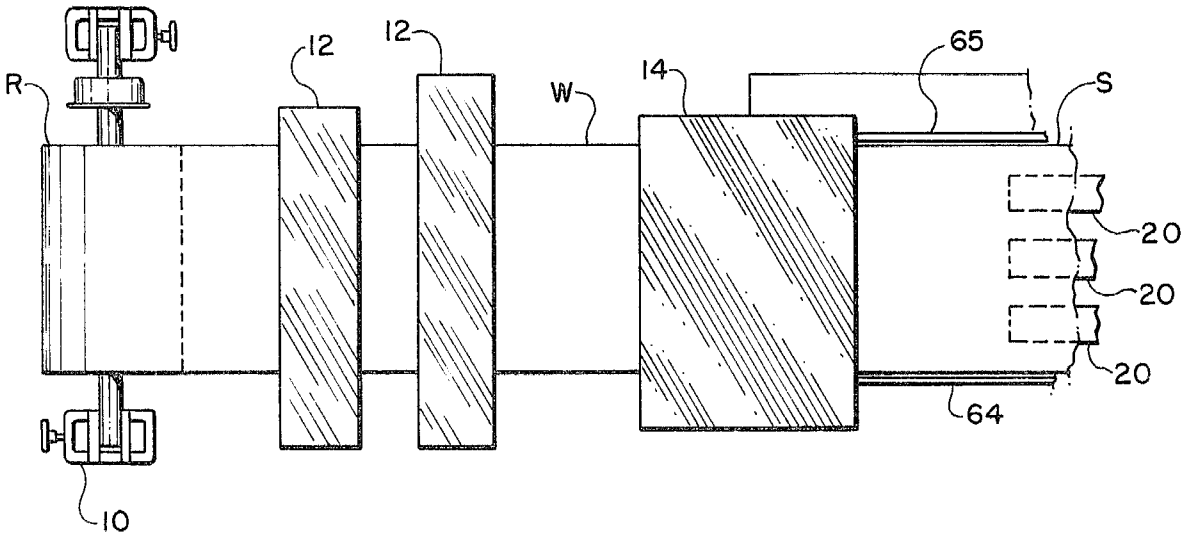
FIG. 1
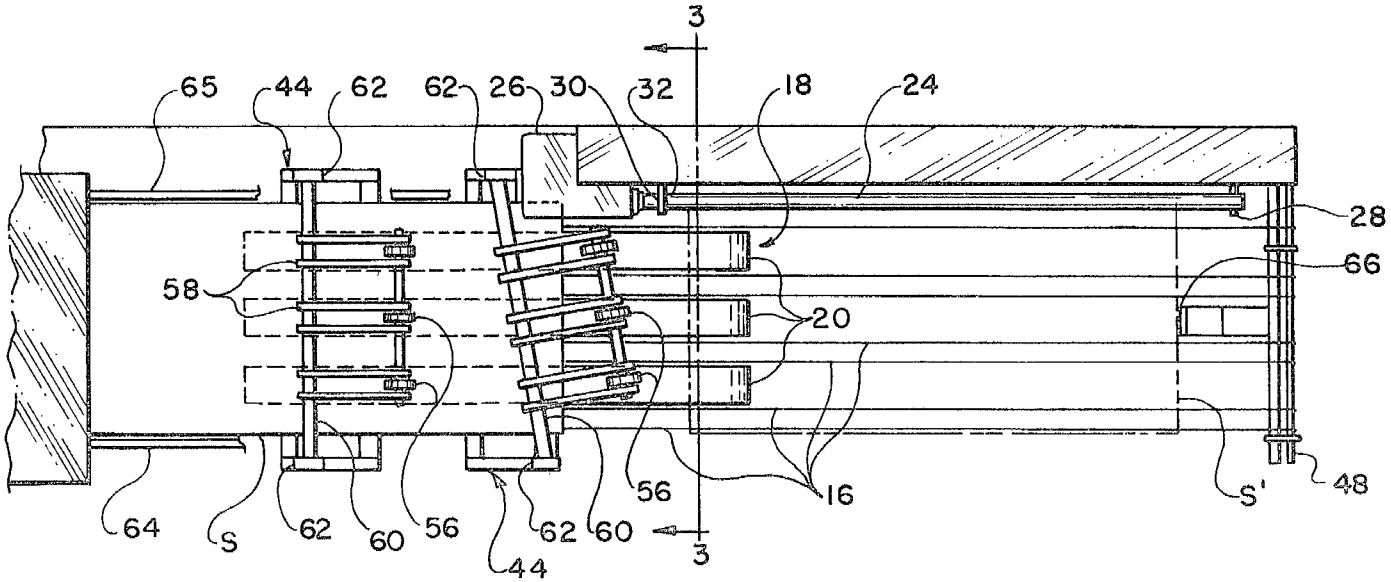

CONVOLUTE PAPER TUBE FORMING APPARATUS AND METHOD

BACKGROUND OF THE INVENTION

The winding of convolute paper tubes in lengths up to about 200" has been practiced routinely for many years. One form of such convolute winding is disclosed in U.S. Pat. No. 3,073,218, which uses means for drawing a strip of paper from a roll, applying an adhesive to the paper, cutting it to the desired length of the tube to be formed, moving the cut length or sheet of paper longitudinally into engagement with a longitudinally extending groove in one side of an elongated mandrel of a length greater than the cut paper sheet, rotating the mandrel to wind the paper sheet thereon in convolute form, and then stripping the tube from the mandrel by a stripper blade moving longitudinally thereof as the next sheet of paper moves into engagement with the mandrel groove.

In the apparatus of the above-mentioned patent, the longitudinal movements of both the paper sheet and the wound tube are derived from a significantly heavy carriage supported on rollers and connected to a chain drive for reciprocation thereby. The reciprocating carriage includes complicated apparatus for plunging sharp pins through the sheet of paper from the underside thereof and near the edge thereof which is to engage the groove in the mandrel. Longitudinal movement of the carriage while the pins are in penetrating relation with the sheet of paper pulls the paper longitudinally of the mandrel until fully engaged in the longitudinal groove therein. The pins are then withdrawn from the paper sheet, leaving it in position to be wound up on the mandrel, while the reciprocating carriage moves in return direction to pick up another sheet of paper.

The reciprocating carriage is necessarily very heavy, about 500 pounds, due to the penetrating pin apparatus included therein, even though the penetrating pins are disposed only near one edge of the sheet of paper in order to keep the weight low and the mechanisms within reason. The heavy carriage requires a heavy drive apparatus, and the reciprocation of the heavy carriage is noisy and results in severe stress with attendant high maintenance and downtime both for the reciprocating apparatus and for the penetrating pin apparatus. Also, as the penetrating pins must accelerate and move the paper sheet along by force applied to the one edge thereof, there is a tendency for the paper to wrinkle and skew, causing misalignment with the mandrel and resultant poor quality tube winding. Pin penetration of, and pulling against, the paper may cause physical damage to the paper and poor quality tubes.

Therefore, it is an object of the present invention to eliminate the heavy reciprocating carriage with its attendant problems, and to provide a means for advancing the paper sheet smoothly into full engagement with the longitudinal groove in the mandrel by carrying the paper sheet on conveyor belts which are frictionally engaged with the paper and are slidable relative to the paper during the acceleration and deceleration of the paper sheet as it is picked up after cutting and then halted in suitable position for winding into a convolute tube. As the conveyor belts engage and support the paper sheet generally across its full width and engage by friction alone, there is less tendency to wrinkle, skew, or misalign the paper, the conveyor belts may be run continuously, without intermittent or reciprocating motion, and the apparatus may be run at a higher cyclic rate in some cases because there is no problem with a heavy reciprocating carriage. The simplicity of the conveyor belts and omission of the penetrating pins eliminate many problems as to maintenance, as well as the higher initial cost of the reciprocating and penetrating pin apparatus and the higher cost for more complicated parts for maintenance.

SUMMARY OF THE INVENTION

Briefly stated, the convolute paper tube forming apparatus of the present invention includes elongated means for engagement of the full length of an edge of a sheet of paper for winding the sheet thereonto to form a tube, and conveying means for causing the sheet to be moved generally parallel to the axis of winding by relatively slidable frictional contact therewith for the full length engagement.

The frictional contact with the conveying means varies during the sheet movement, having substantially less contact as the sheet latterly approaches full length engagement than prior thereto at maximum contact during sheet movement. Means is provided for feeding paper in strip form into the frictional contact with the conveying means at an extending end of the strip and cutting off the extending end to form the sheet of paper, the feeding and cutting means being spaced from the conveying means lengthwise thereof for suitable frictional engagement to accommodate the cutting off. A longitudinal slot in the elongated winding means extends uniformly therealong and partially through its lateral extent, the slot forming the aforesaid means for engagement of the sheet edge, and skewed moving means is provided for contact with the sheet of paper for biasing the engaged sheet edge laterally of the elongated means into the slot for alignment of the sheet with the elongated means during the movement of the sheet. The elongated winding means has a receiving end for the sheet of paper; and the conveying means has a pickup end spaced from the receiving end and a delivery end overlapping the receiving end in lengthwise relation.

Preferably in the apparatus of the invention the conveying means includes a plurality of laterally spaced endless conveyor belts extending generally parallel to the elongated winding means, disposed for conveying the sheet of paper for the full length engagement, and having their conveying surfaces disposed generally coplanar with the winding axis of the winding means. The conveying surfaces extend at a generally horizontal level, and support means for the sheet of paper disposed at a slightly lower level than the conveying surfaces extend beyond them at both ends thereof. The feeding and cutting means halts the feeding of the strip of paper momentarily for the cutting off, and preferably means is provided for forcing the cutoff sheet of paper into increased frictional contact with the conveying means for a period after the cutting off to achieve more uniform and swifter acceleration of the sheet movement for shortening the operational cycle of the apparatus. Preferably, the conveying means has a length less than the full extent of travel of a sheet for full length engagement of the edge thereof, and the conveying means is disposed beneath the sheet, while the skewed moving means for biasing the sheet for alignment with the winding means includes rotating means disposed above the conveying means to roll on the upper surface of the sheet during its movement for full length engagement.

In the preferred embodiment of the invention, the conveyor belts move continuously during operation of the apparatus and may run at selected different speeds to control skewing of the paper sheet during its movement. The support means extends generally from the feeding and cutting means to and beyond the conveying means substantially the full lengthwise extent of the elongated engagement and winding means, and a stop is disposed for halting the sheet of paper in lengthwise relation to the elongated winding means for full length engagement therewith. A guide may be spaced laterally from the winding axis for alignment of the outboard edge of the sheet with the elongated winding means during the sheet movement.

Briefly described, the method of the present invention of feeding a sheet of paper to an elongated convolute paper tube winding means having means for engaging a side-edge of the sheet full length for winding includes the steps of transporting a sheet of paper, by relatively slidable frictional contact with a conveying means, longitudinally along the winding means while in lateral relation thereto for the side-edgewise engaging, and causing the sheet to halt from the transporting with the side edge at a longitudinal position for the full length engaging.

The method of the present invention includes the additional steps of feeding out the leading end of an elongated web of paper in the aforesaid frictional contact with the conveying means and cutting off the web at a predetermined length from the leading end to form the sheet of paper and release it from the web for the aforesaid transporting.

Preferably, the method includes other steps, e.g., those of enhancing the aforesaid frictional contact during the early part of the transporting, diminishing the frictional contact during the latter part of the transporting, and contacting the sheet of paper with skewed moving means for biasing the sheet laterally of and toward the winding means for alignment therewith during the transporting.

In the preferred method of this invention, the frictional contact is enhanced by using means for forcing the sheet of paper into contact with the conveying means, the leading end of the sheet moves from the conveying means progressively onto support means for diminishing the frictional contact with the conveying means and for the aforesaid halting of the sheet by progressively increasing frictional drag of the sheet on the support means.

BRIEF DESCRIPTION OF THE DRAWINGS

FIG. 1 is a plan view of a complete convolute tube winding apparatus in which the preferred embodiment of the present invention is incorporated;

DESCRIPTION OF THE PREFERRED EMBODIMENTS

The preferred embodiment of the present invention provides endless conveyor belts as a means for advancing cut sheets of paper for longitudinal edgewise engagement in a longitudinal groove in one side of a winding mandrel for winding convolute paper tubes. Apparatus and method for such convolute tube winding are fully disclosed in U.S. Pat. No. 3,073,218, the disclosure of which is incorporated herein by reference, and the apparatus and method of the present invention are improvements on the general concept of the apparatus disclosed in that patent, as will be explained hereinafter. In general, in the present invention an endless belt conveyor transports a cut sheet of paper longitudinally of a conventional convolute paper tube winding mandrel into full length edgewise engagement with the longitudinal slot in the mandrel, thereby taking the place of the heavy reciprocating carriage equipped with penetrating pins for positive engagement and transport of the paper sheet as is well known in the art and disclosed in U.S. Pat. No. 3,073,218.

Figure 2:
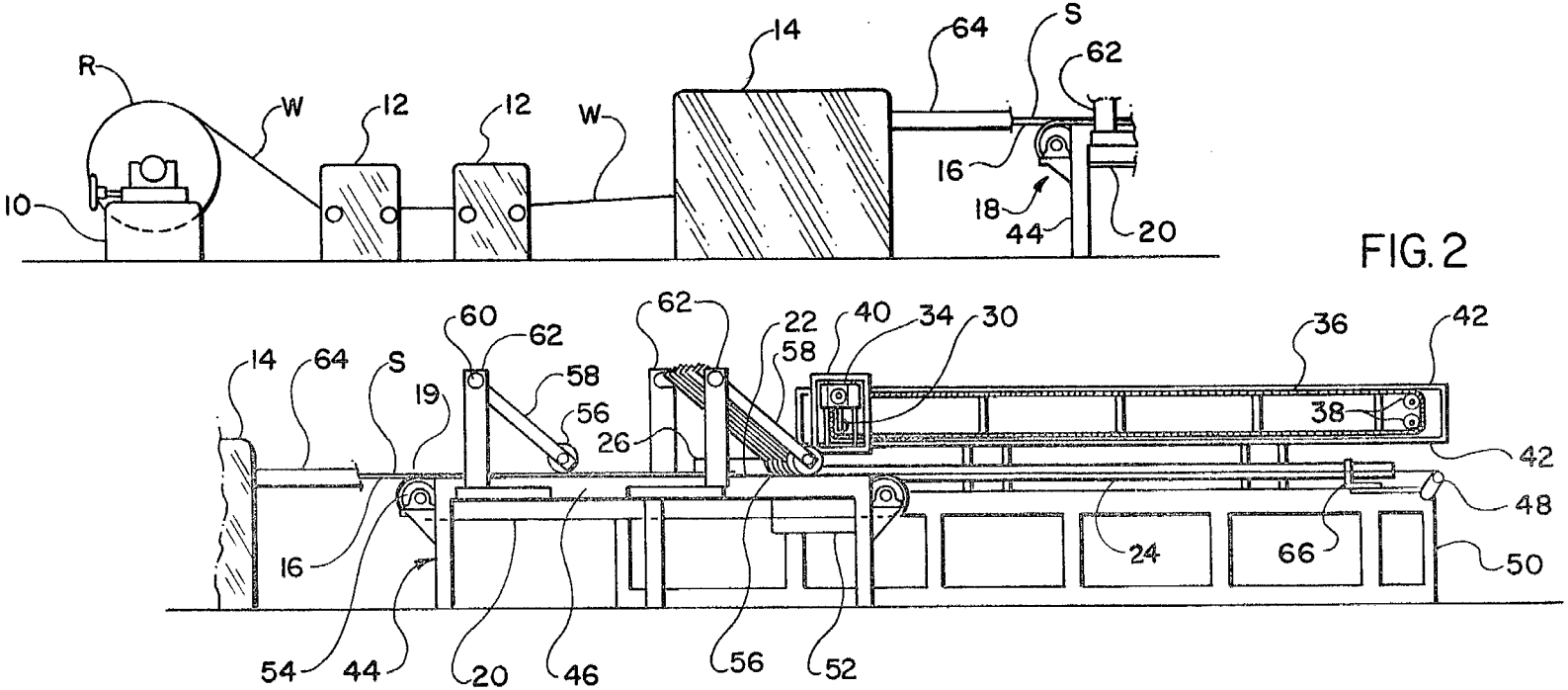
FIG. 2 is a front elevational view of the apparatus illustrated in FIG. 1.
Figure 3:
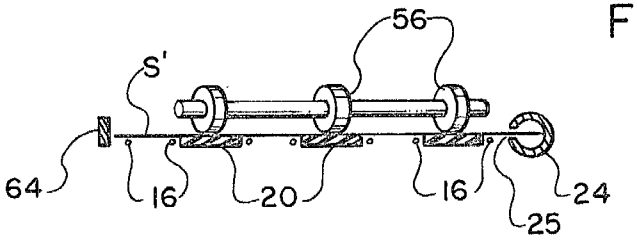
FIG. 3 is a partial vertical cross-sectional view taken along the line 3—3 in FIG. 1.

FIGS. 1 and 2 illustrate a complete set up of apparatus for producing convolute paper tubes of lengths up to about 192" according to the present invention. A roll stand 10 supplies a strip or web of paper W from a roll of paper R to the skiving mechanisms 12, from which the skived-edged web W passes on to the gluing and cutting means or apparatus 14. The gluing and cutting apparatus 14 in well known fashion coats the web of paper with a suitable adhesive while providing means for feeding the web or strip of paper out onto conventional support means, in the form of support wires 16, to a predetermined length whereupon the gluing and cutting apparatus 14 cuts off the web W, creating a sheet of paper S of predetermined length corresponding to the length of convolute tube desired to be formed.

A conveying means 18 has a pickup end 19 spaced longitudinally of the web W beyond the cutting apparatus 14 and includes a plurality of laterally spaced endless conveyor belts 20 whose conveying surfaces 22 are disposed slightly above the support wires 16 and between selected pairs of the wires. The conveying surfaces 22 have relatively slidable frictional contact with the extending end of the web W as it is fed out in strip form from the gluing and cutting apparatus 14 and with the sheet S when it is cut from the extending end of the web W and rests partly, at its trailing end, on the support wires 16.

An elongated mandrel means 24 of the type well known in the art is disposed adjacent the extended path of the web W and generally parallel thereto at one side edge thereof for winding rotation about the longitudinal mandrel axis. As is also well known in the art, the mandrel 24 has a longitudinal slot 25 extending uniformly therealong and partially through the lateral extent thereof. The slot 25 is disposed at the side of the mandrel facing toward the edge of the sheet S, providing means for reception and engagement of the sheet edge thereinto as the sheet S is moved generally parallel to the winding axis of the mandrel by the action of the conveyor belts 20 whose conveying surfaces extend generally parallel and coplanar with the mandrel winding axis. When the sheet S has been moved to a location as indicated in broken lines at S' in FIG. 1 with its edge in full length engagement in the slot in the mandrel 24, the mandrel 24 is rotated for winding the sheet S onto the mandrel to form a tube. The mandrel is rotated from its normal resting or receiving position by a mandrel drive 26 from which it extends and which is also slotted on the side adjacent the sheet S to allow longitudinal passage of the sheet S into the receiving end of the mandrel 24 adjacent the drive 26 into full reception or engagement by the mandrel 24, all as is well known in the art.

The present invention is not intended to be limited to the specific slotted mandrel disclosed, as other mandrels known in the art may be substituted for the mandrel 24 disclosed here with results within the scope of the present invention.

Slicker bars of types known in the prior art support the mandrel and smooth down the convolutions of paper during winding. Because these slicker bars are well known and are disclosed in the aforesaid patent, they are omitted from these drawings as they form no part of the present invention and conventionally are disengaged from the mandrel 24 and moved to a clearance position while the wound tube is stripped from the mandrel 24. A well known movable end support 28 for the mandrel 24 is generally shown in FIG. 1.

A stripper 30 having a conventionally semicircularly recessed end portion for application adjacent the mandrel at the bare portion 32 of the mandrel at the receiving end thereof between the mandrel drive and the trailing end of a paper tube wound on the mandrel is shown in FIG. 2 in a raised position ready to be lowered onto the mandrel 24 at the bare portion 32 for partial encirclement thereof. The stripper 30 is attached to a slide 34 which is pivotally connected to a link of a chain drive 36 which is trained around four sprockets 38 of which two are hidden behind the slide 34 and the stripper 30 in FIG. 2, but are similarly arranged as the two which are shown. The slide 34 is disposed for vertical reciprocatory movement in a carriage 40 which is mounted on rails 42 for horizontal reciprocatory movement parallel to the mandrel 24. Upon rotation of the chain drive 36 in counterclockwise direction, the slide 34 travels in a generally rectangular path such that the attached stripper 30 descends from its position as shown in FIG. 2 to a position adjacent the bare portion of the mandrel 24, and then moves to the right along the mandrel and past the end of the mandrel 24 at which location it ascends to its previous height and then moves leftward to its position as shown in FIG. 2. This is a comparatively lightweight and simple mechanism as compared to the somewhat similar but substantially heavier chain drive and carriage of the prior art, which also carries a paper moving apparatus. The carriage 40, which weighs about 50 pounds, and its accompanying apparatus are omitted from FIG. 1 for clarity.

The conveying means 18 includes a frame structure 44 having a table portion 46 for support of the upper reaches of the conveyor belts 20 to extend at a horizontal level. The aforementioned support wires 16 are stretched taut conventionally between connection to the gluing and cutting apparatus 14 and a support and connection element 48 fixed to the frame 50 of the convolute tube winding apparatus to extend substantially the full lengthwise extent of the mandrel 24. As the wires 16 are intended to form support means for the sheet of paper S where it is not supported by engagement with the belts 20, the wires 16 are disposed between and beside the belts 20 at a slightly lower level than the conveying surfaces 22 of the belts and extend beyond both ends thereof and beyond the free end of the mandrel 24. The wires 16 may rest on and be supported by the top of the table portion 46 of the conveyor frame structure 44, and may alternatively be stretched in segments from cutting apparatus 14 to the left end of the frame 44 and from the right end thereof to the connection element 48. Support bars, rails or a table might be substituted for the wires 16.

Suitable conveyor belt drive means 52 is provided for continuously driving the belts 20 mounted on the pulleys 54 in a direction to convey a sheet of paper S from the cutting apparatus 14 along the side of the mandrel 24. This drive means may be selectively adjustable for driving all the conveyor belts 20 at like, but variable speeds, or to drive the individual belts 20 at different speeds, each selectively variable to control skewing of the sheet during its movement, or to otherwise suitably control sheet movement.

Alternative embodiments could employ an intermittent drive for a conveyor belt or belts 20, and could raise and lower the belt or belts 20 with relation to the wires 16, or vice-versa, for moving the sheet S for full reception by the mandrel 24, and the belts might run full length from the cutting means 14 to the end of the mandrel 24, without departing from the scope of the present invention as claimed. However, the illustrated embodiment is believed to be the simplest, most practical and most versatile.

Above the conveyor belts 20, trim rollers 56, which may be friction surfaced, are mounted for rotation about horizontal axes at one end of trailing arms 58 which are pivoted from a shaft 60 supported above the conveyor belts by upright members 62 connected to the frame 44. The rollers 56 thus rest of their own weight on the belts 20 and provide means for rolling on the upper surface thereof, and forcing a sheet of paper S lying therebetween into enhanced or increased frictional contact with the conveyor belts compared to the frictional contact which would be produced by the weight of the sheet S alone. Typically two sets of trim rollers 56 are provided, one set near the pickup end of the conveying means 18, and the other near the other or delivery end thereof. The pickup end trim rollers may be disposed to rotate in planes generally parallel to the rotational planes of the conveyor belts 20, while the delivery or exit end trim rollers may be skewed slightly as illustrated in FIG. 1 to provide guidance to a sheet S as it passes beneath them but the trim rollers may be skewed or parallel in sets or individually to suitably guide, straighten, de-wrinkle, or otherwise affect the sheet S.

A guide 64, shown only fragmentarily in FIGS. 1 and 2, spaced laterally from the axis of the mandrel 24 may be provided to extend generally from the gluing and cutting apparatus 14 to the end of the mandrel 24 for alignment of the outboard edge of the sheet S with the mandrel 24 during the movement of the sheet S toward full reception by the mandrel. The guide 64 may comprise an upright wall for engagement of the outboard edge of the sheet S, in which case the wires 16 may be loosened or removed to make way for it, and it may include upper and lower guide elements (not shown) for forming an equivalent straddling relationship with the outboard edge of the sheet S as does the longitudinal slot 25 in the mandrel 24 at the other, or inboard, edge of the sheet S. A similar inboard guide 65 may extend from the gluing and cutting apparatus 14 to the mandrel drive 26 to maintain control over the inboard edge of the sheet S. Also, guide means may be provided in the middle of the width of the sheet to minimize wrinkling or buckling.

The aforementioned trim rollers may alternatively be in the form of sprocket wheels with sharpened teeth for enhanced trimming engagement with the sheet.

The mandrel drive 26 is conventionally intermittent, and is connected to the chain drive 36 and a drive means (not shown) for the gluing and cutting apparatus 14 for synchronization therewith as is well known in the art.

In operation, the web of paper W is drawn from the roll of paper R through the skiving mechanisms 12 and through the gluing and cutting apparatus 14, from which it is fed out toward the winding mandrel 24 to a predetermined length first onto the support wires 16 and with further feeding onto the conveying means 18 where it is halted at the predetermined length, part of the sheet S lying on the conveying means 18 and part on the support wires 16. While halted, the web W is cut transversely adjacent the exit end of the gluing and cutting apparatus 14, thereby forming the sheet of paper S of predetermined length. The newly cut off and released sheet S lies on top of the conveying means 18 and is immediately transported thereby toward the extending end of the mandrel 24, a certain amount of slipping taking place between the sheet S and the conveyor belts 20 as the sheet S is accelerated to the speed of the constantly moving belts 20. This slipping is minimized and controlled for a period after the cutting off by the weight of the trim rolls 56 which bias the sheet S against the belts 20 for its maximum frictional contact during its movement therewith, thereby achieving more uniform and swifter acceleration of the sheet movement for shortening the operational cycle of this improved apparatus. The sheet S is then transported by the belts 20 generally parallel to the winding axis of the mandrel 24 with its inboard edge adjacent thereto extending into the longitudinal slot 25 extending along the mandrel 24 until fully engaged with the longitudinal slot.

The trim rolls 56 disposed near the delivery end of the conveying means 18 are circumferentially friction-surfaced and form a skewed moving means for contact with the sheet S for biasing the sheet edge engaged or received by the mandrel 24 laterally into the longitudinal slot 25 for alignment of the sheet S with the elongated mandrel during the movement of the sheet into full length engagement by the mandrel. As the sheet S reaches the latter portion of its movement toward full length engagement or reception by the mandrel 24 (as indicated by the broken line position designated S' in FIG. 1), it is moved out from under the exit end trim rolls 56 and begins to decelerate in its movement due to its increasing frictional contact or drag with the support wires 16 and its variable and diminishing or decreasing frictional contact with the conveyor belts 20. A generally full length sheet of paper as shown at S' may still be in light frictional contact with the belts 20 when fully engaged by the mandrel 24, and a stop 66 adjustably fastened to the frame 50 is disposed to extend into the path of the leading end of the sheet S to halt the sheet in lengthwise relation to the mandrel for full length engagement for winding the sheet S onto the mandrel 24. The stop 66 may extend the full width of the sheet S or may be formed by one or more segmental stops.

Arrival of the sheet S at its position S' may be signaled to the mandrel drive 26 by a suitable detection means, such as a limit switch, or the drive 26 may be otherwise conventionally synchronized to start its winding action at the time when the sheet S is normally fully received by the mandrel 24. Typically, a sheet of shorter length than that shown at S' may coast entirely out of contact with the conveyor belts 20 to some intermediate position along the mandrel 24 short of the end of the mandrel, and the mandrel drive 26 may start its rotation at a predetermined time interval after the sheet S has been cut off from the web W by the gluing and cutting apparatus 14.

In the embodiment illustrated, the conveyor belts 20 extend only slightly coextensive with the mandrel 24 sufficient to provide driving contact with the sheet S to assure full delivery of the sheet into winding position while allowing deceleration of the sheet in arriving at that position and with the contact being limited to allow sliding of the moving belts under the sheet without disrupting the sheet in its winding position. In this arrangement the frictional contact of the sheet on the belts varies during sheet movement, having substantially less contact as the sheet latterly (i.e. during the latter stage of movement) approaches full length engagement in the mandrel slot than it does prior thereto at its maximum contact. Thus, the sheet will be rapidly conveyed from the cutting operation to the winding position with slow down at the latter stage of movement, allowing faster speeds than would be possible with an abrupt stop, and importantly permitting sliding of the sheet on the continuously moving belts once the sheet has stopped at the winding position.

The amount of coextension of the belts and mandrel can be varied as desired for selected best conditions depending on the stiffness and length of the paper sheet, the coefficient of friction between the belts and paper sheet and the speed of the belts. Under some conditions full coextension may be acceptable and it may be possible under other conditions to have no coextension, with the paper sheet simply coasting from the belts into winding position. Also, if the amount of coextension is properly selected, it may be possible to deliver the paper sheet into winding position without needing a stop with the amount of belt and paper sheet overlap being insufficient to cause the belts to further advance the sheet when the sheet has proper winding position.

As tubes of various lengths and wall thicknesses may be convolutely wound from various thicknesses of paper, the guide and stop elements may be adjustable in position, and the trim rolls may be adjustable as to position, skew angle, and weight exerted on a paper sheet S for control purposes in achieving a smooth pick up, acceleration, guidance, deceleration, and stop of a sheet S for full length engagement by the mandrel 24. The pickup end of the conveying means 18 is spaced from the gluing and cutting apparatus 14 for a suitably low frictional contact with the web W during cutoff to accommodate any tendency to skew the sheet S at the movement of cutoff (due to dull cutters), yet suitably for picking up the shortest sheet S which is contemplated for winding. The exit or delivery end of the conveying means 18 extends in overlapping lengthwise relationship with the receiving end of the mandrel 24 such that any length or weight sheet of paper S will be transported into full length engagement by the mandrel 24 leaving a suitable bare portion 32 at the receiving end for positioning of the stripper 30 behind the trailing end of a wound tube. Preferably the conveying means has a length shorter than the full extent of travel of a sheet S for such full length engagement.

The chain drive 36 is synchronized with the mandrel drive 26 and the slicker bar drive mechanism (not shown) such that upon completion of the winding of a tube and the conventional removal of the slicker bars to a clearance position, the stripper 30 will be positioned adjacent and partially encircling the mandrel 24 for subsequent longitudinal movement along the mandrel for stripping the just-wound tube therefrom.

Other slightly skewed arrangements of the elements of the apparatus may be in order to guide the sheets of paper or to compensate for various irregularities in paper, feed belts, glue, atmospheric conditions or other conditions including, but not limited to, some slight convergence of the support wires 16, if suitable, and the conveyor belts 20 with the mandrel 24, and such convergence could be considered to form an equivalent of the skewed trim rollers 56, which might be omitted. Also, in some cases secondary conveyor belts (not shown) similar to belts 20, but shorter than the mandrel 24 and located for coextension therewith, may be provided for further control, guiding, biasing, or control of the sheets S. These secondary belts may run at different speeds, generally slower, than the belts 20, they may be skewed or angled suitably, and additional trim rollers 56 may be provided above the secondary belts.

The particular embodiment disclosed in full detail herein and illustrated in the drawings and incorporated in this disclosure by reference to U.S. Pat. No. 3,073,218, has been provided for disclosure purposes only and is not intended to limit the scope of the present invention, which is to be determined solely by the scope of the appended claims.

We claim:

1. A convolute paper tube forming apparatus comprising elongated means for engagement of the full length of an edge of a sheet of paper and means for rotating said elongated means for winding said sheet onto said elongated means about the longitudinal axis thereof to form a tube, and continuously-advancing conveying means disposed adjacent said elongated means for causing said sheet to be moved generally parallel to the axis of said winding by relatively slidable frictional contact of said sheet with said conveying means for axial movement of said sheet edge longitudinally and progressively into said full length winding engagement.

2. A convolute paper tube forming apparatus according to claim 1 and characterized further by disposition of said conveying means relative to said elongated means for causing said frictional contact to vary during movement by said contact, being substantially less as said sheet latterly approaches said full length engagement than prior thereto at maximum said contact during said movement.

3. A convolute paper tube forming apparatus according to claim 1 and characterized further in that said conveying means comprises a plurality of laterally spaced endless conveyor belts extending generally parallel to said elongated means and disposed for conveying said sheet for said engagement by said elongated means.

4. A convolute paper tube forming apparatus according to claim 3 and characterized further by support means for said sheet disposed at a slightly lower level than the conveying surfaces of said belts and extending beyond said conveying surfaces at both ends thereof, and in that said support means comprises taut wires disposed between said belts.

5. A convolute paper tube forming apparatus according to claim 3 and characterized further in that said belts run at selected different speeds to control skewing of said sheet during said sheet movement.

6. A convolute paper tube forming apparatus according to claim 1 and characterized further in that said conveying means comprises endless conveyor belt means extending generally parallel to said elongated means and disposed for conveying said sheet for said engagement by said elongated means, and in that the conveying surface of said belt means is disposed generally coplanar with the axis of said winding.

7. A convolute paper tube forming apparatus according to claim 6 and characterized further by means for causing said belt means to move continuously during operation of the apparatus.

8. A convolute paper tube forming apparatus according to claim 6 and characterized further by means for feeding paper in strip form into said frictional contact with said conveying means at an extending end of said strip and cutting off said extending end to form said sheet, said feeding and cutting means being spaced from said conveying means lengthwise thereof for suitable frictional engagement to accommodate said cutting off.

9. A convolute paper tube forming apparatus according to claim 8 and characterized further in that said feeding and cutting means momentarily halts said strip for said cutting off, and by means for forcing said sheet into increased frictional contact with said conveying means for a period after said cutting off to achieve more uniform and swifter acceleration of said sheet movement for shortening the operational cycle of the apparatus.

10. A convolute paper tube forming apparatus according to claim 9 and characterized further by rollers comprising said forcing means, said conveying means being disposed beneath said sheet and said rollers being disposed above said conveying means to roll on the upper surface of said sheet during said movement.

11. A convolute paper tube forming apparatus according to claim 1 and characterized further in that said conveying means comprises endless conveyor belt means extending generally parallel to said elongated means and disposed for conveying said sheet for said engagement by said elongated means, in that the conveying surface of said belt means is disposed generally coplanar with the axis of said winding, in that said conveying surface extends generally horizontally, and by support means for said sheet disposed at a slightly lower level than the conveying surface of said belt means and extending beyond said conveying surface at both ends thereof.

12. A convolute paper tube forming apparatus according to claim 11 and characterized further by means for feeding paper in strip form into said frictional contact with said conveying means at an extending end of said strip and cutting off said extending end to form said sheet, said feeding and cutting means being spaced from said conveying means lengthwise thereof for suitable frictional engagement to accommodate said cutting off, and in that said support means is disposed to extend generally from said feeding and cutting means to said conveying means and to extend beyond said conveying means to substantially the full lengthwise extent of said elongated engagement and winding means.

13. A convolute paper tube forming apparatus according to claim 12 and characterized further by a stop disposed for halting said sheet in lengthwise relation to said elongated means for said full length engagement.

14. A convolute paper tube forming apparatus according to claim 1 and characterized further in that said elongated means has a receiving end for said sheet, said conveying means has a pickup end spaced from said receiving end and a delivery end overlapping said receiving end in lengthwise relation.

15. A convolute paper tube forming apparatus according to claim 14 and characterized further in that said conveying means has a length less than that of said elongated means.

16. A convolute paper tube forming apparatus according to claim 1 and characterized further by a guide spaced laterally from the axis of said winding for alignment of the outboard edge of said sheet with said elongated means during said movement of said sheet.

17. A convolute paper tube forming apparatus according to claim 1 and characterized further by a longitudinal slot in said elongated means extending uniformly therealong and partially through the lateral extent thereof, said slot comprising said means for engagement of said sheet edge, and skewed moving means for contact with said sheet for biasing said engaged sheet edge laterally of said elongated means into said slot for alignment of said sheet with said elongated means during said movement.

18. A convolute paper tube forming apparatus according to claim 17 and characterized further in that said conveying means is disposed beneath said sheet and said skewed moving means comprises rotating means disposed above said conveying means to roll on the upper surface of said sheet during said movement.

19. A convolute paper tube forming apparatus according to claim 1 and characterized further by means for feeding paper in strip form into said frictional contact with said conveying means at an extending end of said strip and cutting off said extending end to form said sheet, said feeding and cutting means being spaced from said conveying means lengthwise thereof for suitable frictional engagement to accommodate said cutting off.

20. A convolute paper tube forming apparatus according to claim 19 and characterized further in that said feeding and cutting means momentarily halts said strip for said cutting off, and by means for forcing said sheet into increased frictional contact with said conveying means for a period after said cutting off to achieve more uniform and swifter acceleration of said sheet movement for shortening the operational cycle of the apparatus.

21. A convolute paper tube forming apparatus according to claim 20 and characterized further by rollers comprising said forcing means, said conveying means being disposed beneath said sheet and said rollers being disposed above said conveying means to roll on the upper surface of said sheet during said movement.

22. A method of feeding a sheet of paper to an elongated convolute paper tube winding means having means for engaging a side-edge of the sheet full length for said winding comprising the steps of:

(a) transporting a sheet of paper, by relatively slidable frictional contact with a continuously-advancing conveying means, longitudinally along said winding means while in lateral relation thereto for said side-edgewise engaging, progressively into full length side-edge engagement therewith; and (b) causing said sheet to halt from said transporting with said side edge at a longitudinal position for said full length engaging.

23. A method of feeding a sheet of paper to an elongated convolute paper tube winding means according to claim 22 and characterized further by the additional steps of:

(c) feeding out the leading end of an elongated web of paper into said frictional contact; and (d) cutting off said web at a predetermined length from said end to form said sheet and release it from said web for said transporting.

24. A method of feeding a sheet of paper to an elongated convolute paper tube winding means according to claim 19 and characterized further by the additional step of enhancing said frictional contact during the early part of said transporting.

25. A method of feeding a sheet of paper to an elongated convolute paper tube winding means according to claim 24 and characterized further by using means for forcing said sheet into contact with said conveying means for said enhancing.

26. A method of feeding a sheet of paper to an elongated convolute paper tube winding means according to claim 24 and characterized further by the additional step of diminishing said frictional contact during the latter part of said transporting.

27. A method of feeding a sheet of paper to an elongated convolute paper tube winding means according to claim 26 and characterized further in that the leading end of said sheet moves from said conveying means progressively onto support means for said diminishing frictional contact and for said halting by progressively increasing frictional drag of said sheet on said support means.

28. A method of feeding a sheet of paper to an elongated convolute paper tube winding means according to claim 22 and characterized further by the additional step of contacting said sheet with skewed moving means for biasing said sheet laterally of and toward said winding means for alignment therewith during said transporting.

29. A method of feeding a sheet of paper to an elongated convolute paper tube winding means according to claim 22 and characterized further by the additional step of guiding said sheet at the outboard edge thereof by a guide spaced laterally from said winding means and disposed generally parallel thereto for alignment of said sheet therewith.

* * * * *

UNITED STATES PATENT OFFICE

CERTIFICATE OF CORRECTION

Patent No. 4,270,443 Dated June 2, 1981

Inventor(s) Thomas L. McSwiney et al

It is certified that error appears in the above-identified patent and that said Letters Patent are hereby corrected as shown below:

Column 12, line 19, delete "19" and insert therefor --22--.

Signed and Sealed this

Twenty-second Day of June 1982

[SEAL]

Attest:

GERALD J. MOSSINGHOFF

Attesting Officer

Commissioner of Patents and Trademarks